US006380835B1

(12) United States Patent
Lee

(10) Patent No.: US 6,380,835 B1
(45) Date of Patent: Apr. 30, 2002

(54) SYMMETRIC MULTI-LAYER SPIRAL INDUCTOR FOR USE IN RF INTEGRATED CIRCUITS

(75) Inventor: Sang Gug Lee, Taejon (KR)

(73) Assignee: Informaton and Communications University, Taejon (KR)

( * ) Notice: Subject to any disclaimer, the term of this patent is extended or adjusted under 35 U.S.C. 154(b) by 0 days.

(21) Appl. No.: 09/558,394

(22) Filed: Apr. 25, 2000

(30) Foreign Application Priority Data

Jul. 27, 1999 (KR) ..... 99-30665

(51) Int. Cl.[7] ..... H01F 5/00

(52) U.S. Cl. ..... 336/200; 336/232; 336/223

(58) Field of Search ..... 336/200, 223, 336/232

(56) References Cited

U.S. PATENT DOCUMENTS 4,959,631 A * 9/1990 Hasegawa et al. ..... 336/83
5,349,743 A * 9/1994 Grader et al. ..... 29/602.1
5,572,173 A * 11/1996 Ogawa et al. ..... 333/187

OTHER PUBLICATIONS

Jan Craninckx and Michel S. J. Steyaert, "A Fully Integrated CMOS DCS–1800 Frequency Synthesizer" IEEE Journal of Solid–State Circuits, Dec. 1998, vol. 33, No. 12, pp. 2054–2065.

Joachim N. Burghartz, Keith A. Jenkins and Mehmet Soyuer, "Multilevel–Spiral Inductors Using VLSI Interconnect Technology" IEEE Electron Device Letters, Sep. 1996, vol. 17, No. 9, pp. 428–430.

* cited by examiner

*Primary Examiner*—Anh Mai
(74) *Attorney, Agent, or Firm*—Rosenman & Colin LLP

(57) ABSTRACT

A symmetric multi-layer inductor, providing an increased inductance of a conventional dual-layer inductor, exhibits a quality factor comparable to or better than that of a conventional single-layer inductor. The inductor includes a top metal patterned layer provided with a pair of groups of N number of metal lines, a bottom metal patterned layer, disposed between the substrate and the top metal patterned layer, provided with a pair of groups of N number of metal lines and an insulating material surrounding each of the metal patterned layers. In the inductor, the group of N number of metal lines on the each metal patterned layer and the other group of N number of metal lines on the same metal patterned layer are symmetric to each other with respect to an imaginary central line. Each of the metal lines has at least one via hole at one end thereof.

16 Claims, 7 Drawing Sheets

SYMMETRIC MULTI-LAYER SPIRAL INDUCTOR FOR USE IN RF INTEGRATED CIRCUITS

FIELD OF THE INVENTION

The present invention is related to an inductor; and, more particularly, to an area efficient and symmetric multi-layer spiral inductor for use in RF integrated circuits.

DESCRIPTION OF THE PRIOR ART

Monolithic spiral inductors have been used in many microwave and RF ICs as low noise amplifiers, mixers, voltage controlled oscillators, and so on. The monolithic inductors are utilized to implement on-chip matching networks, passive filters, inductive loads, transformers, baluns, and so on. As silicon technology gradually dominating the RF IC market, the rising demand for high quality monolithic inductors has led to a significant progress in the silicon-based monolithic spiral inductor design techniques.

There is shown in FIG. 1 a layout of a conventional single-layer spiral inductor 10.

As can be seen from the figure, the single-layer spiral inductor 10 is a three-turn inductor which includes an input port 12, a metal line 14 in the form of a spiral, a pair of contacts 16, a bridge metal 17 and an output port 18, wherein one of the contacts 16 is formed at one end of the metal line 14 and the other contact 16 is formed at one end of the output port 18. The contacts 16 are electrically connected to each other through the bridge metal 17, allowing a current inputted to the input port 12 to flow out through the output port 18 after passing through the metal line 14.

One of the major shortcomings associated with the above-described single-layer spiral inductor 10 is the area efficiency. For a given silicon area, the inductance provided from the single-layer spiral inductor is relatively low and to overcome this shortcoming, a dual-layer spiral inductor 20 has been proposed.

There is illustrated in FIG. 2 a conventional dual-layer spiral inductor 20, as further described in Joachim N. Burghartz and Keith A. Jenkins, "Multilevel-Spiral Inductors Using VLSI Interconnect Technology", *IEEE Electron Device Letters,* Vol. 17, No. 9, pp. 428–430, September 1996. The dual-layer spiral inductor 20 includes a top and a bottom metal line 24, 25, an input port 22, a contact 26 and an output port 28. As shown in FIG. 2, the top and bottom metal line are in the form of a spiral, each having three turns. The input port 22 is connected to one end of the top metal line 24, and the contact 26, e.g., a via hole, which is formed at the other end of the top metal line 24. The output port 28 is connected to one end of bottom metal line. The bottom metal line 25 is formed on top of the semiconductor substrate, and the top metal line 24 is formed over the bottom metal line 25 with an oxide such as $SiO_2$ filling therebetween.

The top metal line 24 is connected to the bottom metal line 25 through the contact 26, thereby allowing a current inputted to the input port 22 to flow out through the output port 28 after passing through the top and the bottom metal line 24 and 25.

The inductance of the dual-layer spiral inductor 20 described hereinabove is about 4 times that of the single-layer spiral inductor 10 for a given silicon area. However, the dual-layer spiral inductor 20 has a drawback for being asymmetric, causing the inductance at the output port 28 and that at the input port 22 to be different from each other.

SUMMARY OF THE INVENTION

It is, therefore, a primary object of the present invention to provide a multi-layer inductor for use in RF integrated circuits which is capable of, as well as having a symmetry for providing same inductance values observed at the input port and the output port thereof, exhibiting a quality factor comparable to or better than that of a conventional single-layer inductor.

In accordance with the present invention, there is provided a symmetric dual-layer spiral inductor incorporating spirals, each having N number of turns, N representing a turn number, being a natural number and greater than 1, comprising: a substrate; a top metal patterned layer provided with a 1st group of N first metal lines and a 2nd group of N second metal lines; a bottom metal patterned layer, disposed between the substrate and the top metal patterned layer, provided with a 1st set of N third metal lines, each corresponding to one of the N first metal lines with the same turn number, and a 2nd set of N fourth metal lines, each corresponding to one of the N second metal lines with the same turn number, each of the metal lines having a 1st and a 2nd end and being decreased in size as the turn number being decreased, the 1st end each first metal line being electrically connected to the 1st end of the corresponding fourth metal line, the 2nd end of the fourth metal line being electrically connected to the 2nd end of the corresponding (n−1)th first metal line by descending the turn number thereof from N to 1, the 2nd end of the smallest, i.e., 1st, fourth metal line being connected to that of the smallest, i.e., 1st, third metal line provided that N reaches 1, each of the 1st ends of the third metal lines being electrically connected to the 1st ends of the corresponding second metal lines and the 2nd end of the second metal line being electrically connected to the 2nd end of the corresponding (n+1)st third metal line by rising the turn number thereof from 1 to N; and an insulating material surrounding each of the metal lines.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

There are illustrated in FIGS. 3 to 6 inventive symmetric inductors in accordance with preferred embodiments of the present invention.

Figure 1:
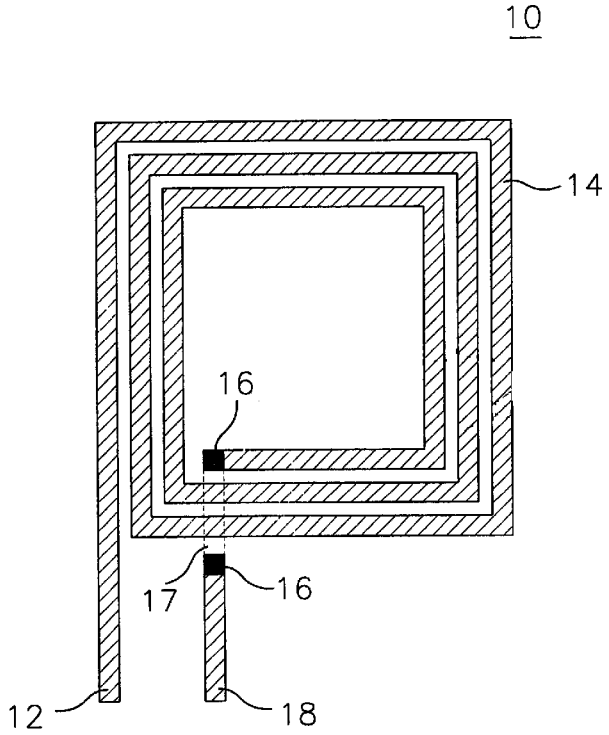
FIG. 1 (PRIOR ART)
FIG. 1 represents a top view of a prior art single-layer spiral inductor.
Figure 2:
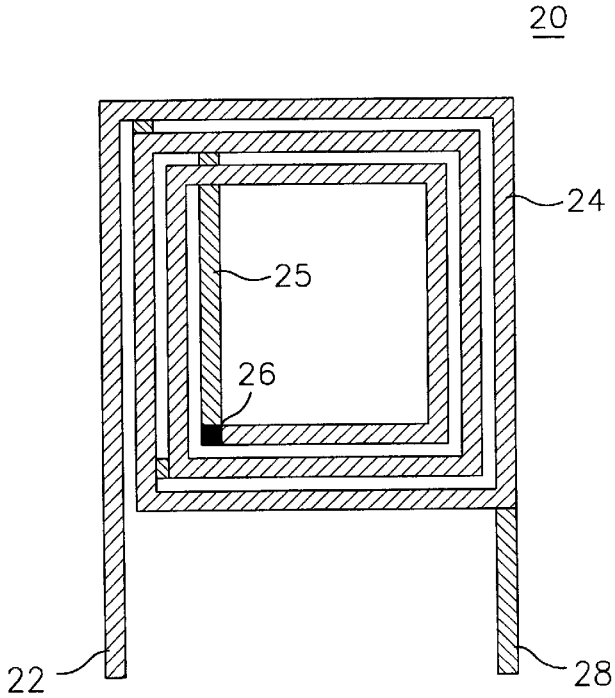
FIG. 2 (PRIOR ART)
FIG. 2 shows a top view of a conventional dual-layer spiral inductor.
Figure 3A:
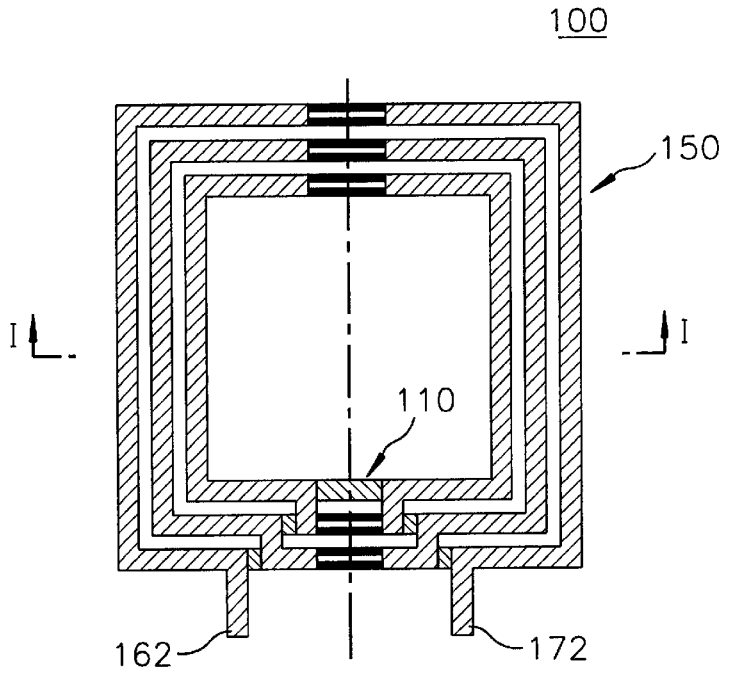
FIG. 3A is a top view of a symmetric dual-layer inductor in accordance with a first preferred embodiment of the present invention.

FIG. 3A shows a top view of the symmetric dual-layer inductor 100 for use in RF integrated circuits in accordance with a first preferred embodiment of the present invention. The symmetric dual-layer inductor 100 comprises a substrate 102, a bottom metal patterned layer 110 formed on top of the substrate 102, a top metal patterned layer 150, provided with an input and an output ports 162, 172, formed over the bottom metal patterned layer 110 and an insulating material 104 surrounding the bottom and the top metal patterned layer 110, 150, as shown in FIG. 3D. The dual-layer symmetric inductor 100 is symmetric with respect to an imaginary center line represented by one-dot dashed line in FIG. 3A. The substrate 102 is made of a semiconductor material such as silicon and the insulating material 104 for electrically isolating the metal patterned layers 110, 150 from each other is usually an oxide, e.g., $SiO_2$.

Figure 3B:
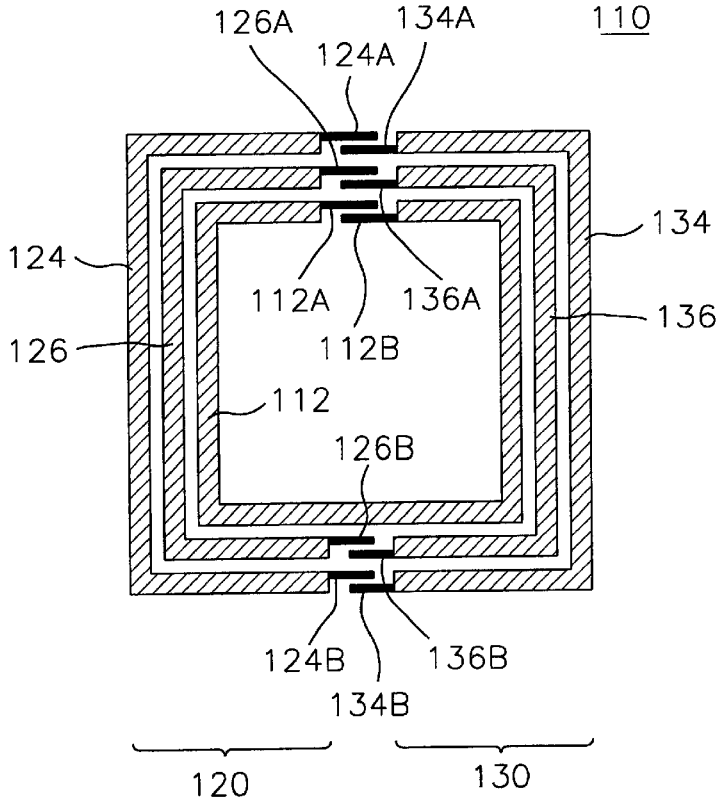
FIGS. 3B and 3C show layouts of the top and the bottom metal patterned layer of the symmetric dual-layer inductor shown in FIG. 3A, respectively.

FIG. 3B shows a layout of the bottom metal patterned layer 110 of the symmetric dual-layer inductor 100 shown in FIG. 3A. The bottom metal patterned layer 110 includes an inner most metal line 112, a first set 120 of metal lines 124, 126 and a second set 130 of metal lines 134, 136. The inner most metal line 112 of the bottom metal patterned layer 110 is in the form of an open rectangular loop. Each of the metal lines, e.g., 124, is provided with a pair of via holes 124A, 124B, all the via holes being filled with an electrically conducting material and located at both ends thereof, respectively. The metal lines 124, 126, 134 and 136 of the bottom metal patterned layer 110 are in the form of a semi-rectangular loop, the semi-rectangular loops getting smaller as they get nearer to the inner most metal line 112. In accordance with the preferred embodiment of the present invention, the first and the second set 120, 130 of metal lines of the bottom metal patterned layer 110 are symmetrical with respect to the one-dashed dot line shown in FIG. 3A.

Figure 3C:
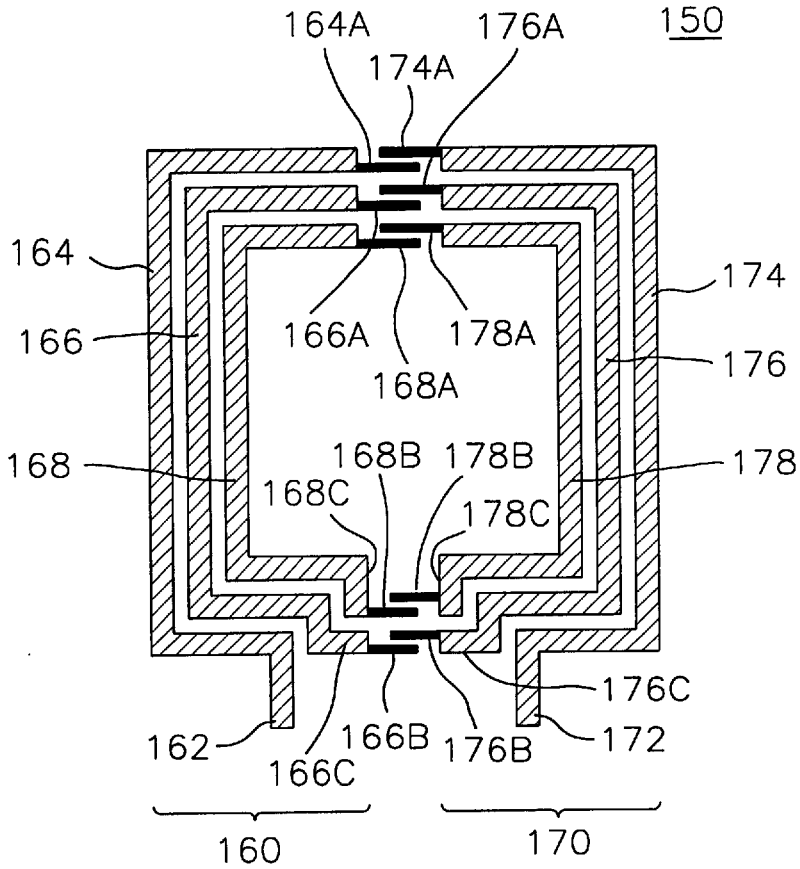
Figure 3D:
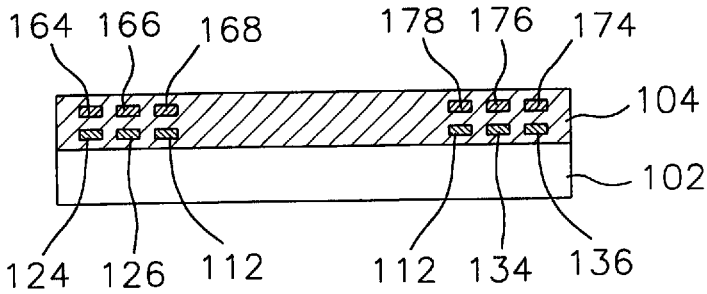
FIG. 3D presents a cross-sectional view of the symmetric dual-layer inductor taken along a line I—I shown in FIG. 3A.

FIG. 3C presents a layout of the top metal patterned layer 150 of the dual-layer symmetric inductor 100 shown in FIG. 3A. The top metal patterned layer 150 includes a first group 160 provided with an outmost metal line 164 and a pair of metal lines 166, 168 and a second group 170 provided with an outmost metal line 174 and a pair of metal lines 176, 178. In accordance with the preferred embodiment of the present invention, the first and the second group 160, 170 of metal lines of the top metal patterned layer 150 are symmetrical with respect to the one-dashed dot line shown in FIG. 3A. The outmost metal line 164 of the first group 160 has an input port 162 at one end thereof and a via hole 164A at the other end thereof. Each of the metal lines of the top metal patterned layer 150 is in the form of a semi-rectangular loop with one end thereof substantially being bent to facilitate its alignment with a corresponding metal line in the bottom metal patterned layer 110. The outmost metal line 174 of the second group 170 has an output port 172 at one end thereof and a via hole 174A at the other end thereof. Each of the metal lines, e.g., 166, includes a bent portion 166C which is located at one end thereof and a pair of via holes 166A, 166B, the via holes 166A and 166B being placed at one end of the metal line 166 and the end of the bent portion 166C, respectively. It is preferable that the metal lines of the top metal patterned layer 150 are made of the same material as those in the bottom metal patterned layer 110. It should also be understood that the invention is not limited to use of the metal lines in the top and the bottom metal patterned layers having a specific shape,i.e., rectangle. In other word, the top and bottom metal patterned layers can be of any other shape as long as they are symmetric.

In the inventive symmetric dual-layer spiral inductor, a current flowing into the input port 162 flows into the metal line 134 of the second set 130 in the bottom metal patterned layer 110 through the via holes 164A, 134A, after passing through the outmost metal line 164 of the first group 160 in the top metal patterned layer 150, wherein the outmost metal line 164 of the first group 160 and the metal line 134 of the second set 130 are electrically connected to each other through the via holes 164A, 134A. The current after passing through the metal line 134 of the second set 130 of the bottom metal patterned layer 110 flows into the metal line 166 of the first group 160 in the top metal patterned layer 150 through the via holes 134B and 166B, through which the metal line 166 of the first group 160 and the metal line 134 of the second set 130 are electrically connected to each other. The current after flowing through the metal line 166 of the first group 160 of the top metal patterned layer 150 flows into the metal line 136 of the second set 130 of the bottom metal patterned layer 110 through the via hole 166A, 136A, through which the metal line 166 of the first group 160 and the metal line 136 of the second set 130 are electrically connected to each other. The current then flows into the metal line 168 of the first group 160 of the top metal patterned layer 150 through the via holes 136B and 168B through which the metal line 168 of the first group 160 and the metal line 136 of the second set 130 are electrically connected to each other. The current, after flowing through the metal line 168 of the first group 160 of the top metal patterned layer 150, flows into the inner most metal line 112 of the bottom metal patterned layer 110 through the via holes 168A and 112B through which the metal line 168 of the first group 160 in the top metal patterned layer 150 and the inner most metal line 112 of the bottom metal patterned layer 110 are electrically connected to each other.

The current, after flowing through the inner most metal line 112 of the bottom metal patterned layer 110, flows into the metal line 178 of the second group 170 of the top metal patterned layer 150 through the via holes 178A and 112A, through which the inner most metal line 112 of the bottom metal patterned layer 110 and the metal line 178 of the second group 170 are electrically connected to each other. The current then flows into the metal line 126 of the first set 120 of the bottom metal patterned layer 110 through the via holes 178B and 126B, the via holes being used to electrically connect the metal line 178 of the second group 170 of the top metal patterned layer 150 to the inner most metal line 112 of the bottom metal patterned layer 110. The current after flowing through the metal line 126 of the first set 120 in the bottom metal patterned layer 110 flows into the metal line 176 of the second group 170 in the top metal patterned layer 150 through the via holes 176A and 126A, the via holes being used to electrically connect the metal line 176 of the second group 170 to the metal line 126 of the first set 120. After flowing through the metal line 176 of the second group 170 of the top metal patterned layer 150, the current flows into the metal line 124 of the first set 120 of the bottom metal patterned layer 110 through the via holes 176B and 124B, the via holes being used to electrically connect the metal line 176 of the second group 170 to the metal line 124 of the first set 120. Thereafter, the current flows into the metal line 174 of the second group 170 of the top metal patterned layer 150 through the via holes 174A and 124A and passes out through the output port 172, the via holes being used to electrically connect the metal line 174 of the second group 170 to the metal line 124 of the first set 120.

As a result of the symmetric arrangement of the metal patterned layers, the present dual-layer symmetric inductor 100 exhibits a symmetric inductance characteristics or a profile and a quality factor as well as an increased inductance comparable to that of a conventional single-layer inductor 20.

Figure 4:
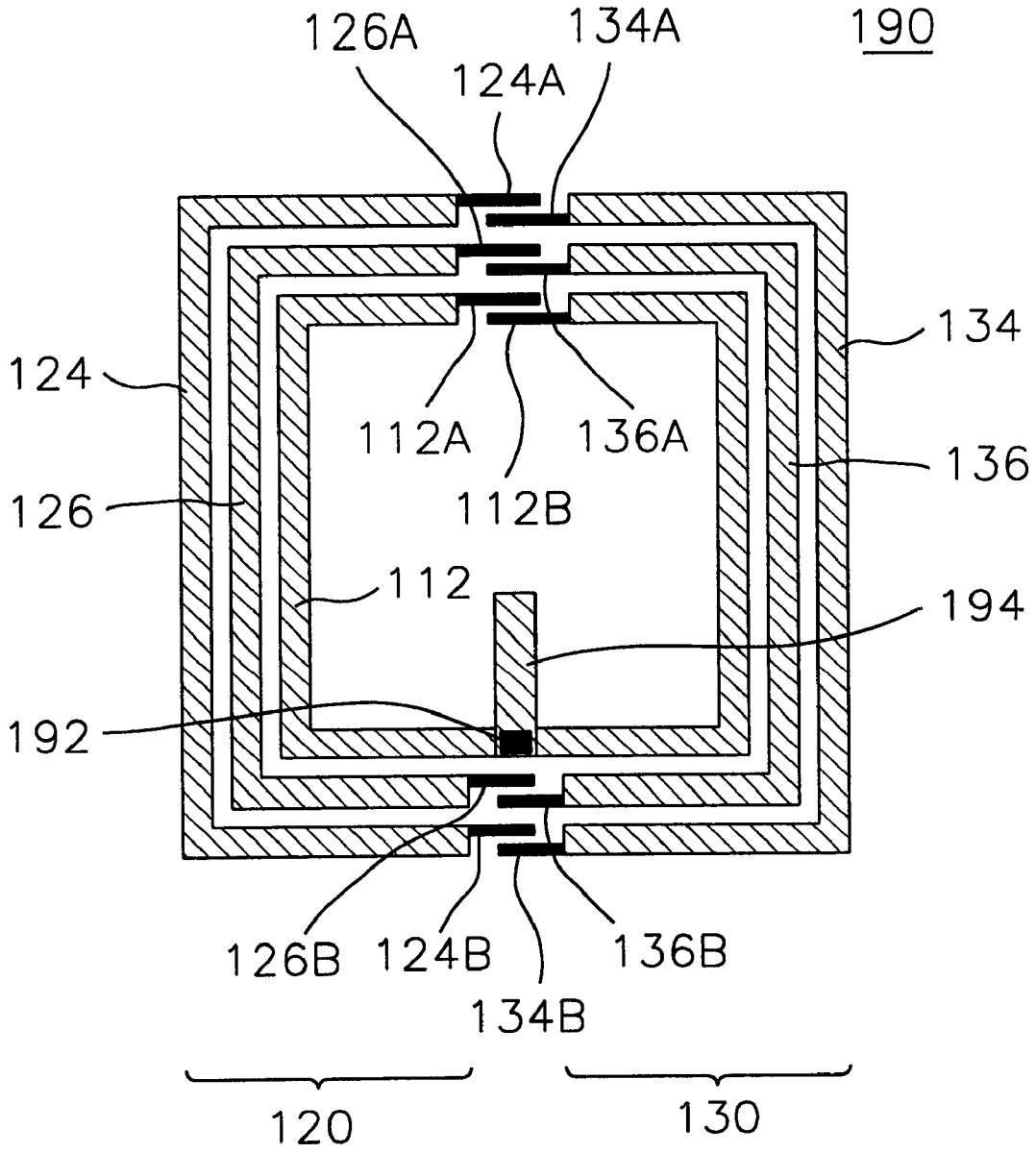
FIG. 4 depicts a layout of a bottom metal patterned layer of the symmetric dual-layer inductor in accordance with a second preferred embodiment of the present invention.

In FIG. 4, there is shown a layout of a bottom metal patterned layer 190 of a dual-layer symmetric inductor in accordance with a second preferred embodiment of the present invention. The bottom metal patterned layer 190 of this embodiment is similar to the bottom metal patterned layer 110 shown in FIG. 3B except that the inner most metal line 112 is divided into two portions by a via hole 192 located at a center thereof. An additional port 194 is connected to the via hole 192, wherein the via hole is filled with an electrically conducting material, thereby allowing the dual-layer symmetric inductor incorporating therein the bottom metal patterned layer 190 to serve as two inductors whose inductances are equal to each other. In addition, an the additional port 194 can be placed outside of the bottom metal patterned layer 190 by forming the additional port 194 at a level different from the top and bottom metal patterned layer 150, 190.

Figure 5A:
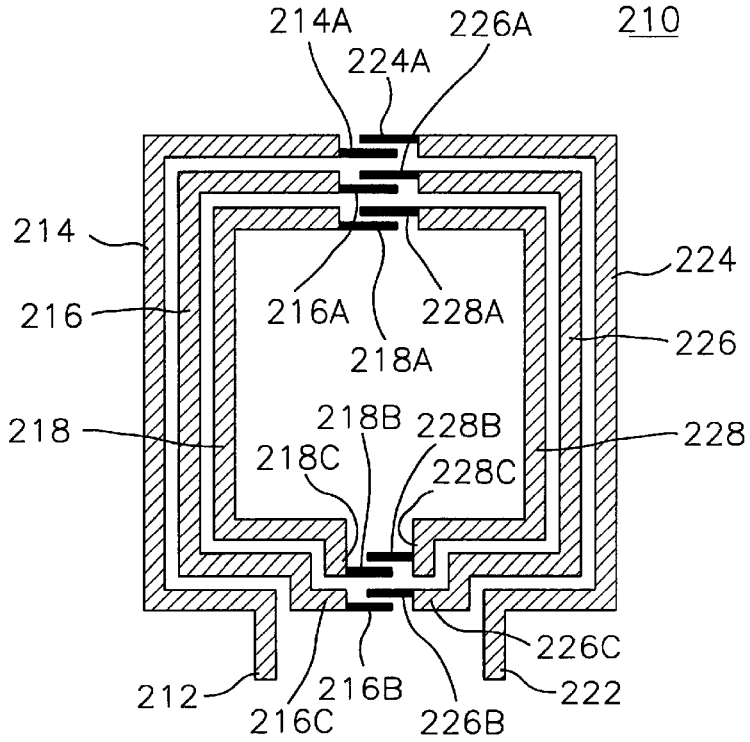
FIGS. 5A to 5D show layouts of metal patterned layers of a symmetric four-layer inductor, respectively, in accordance with a third preferred embodiment of present invention.
Figure 5B:
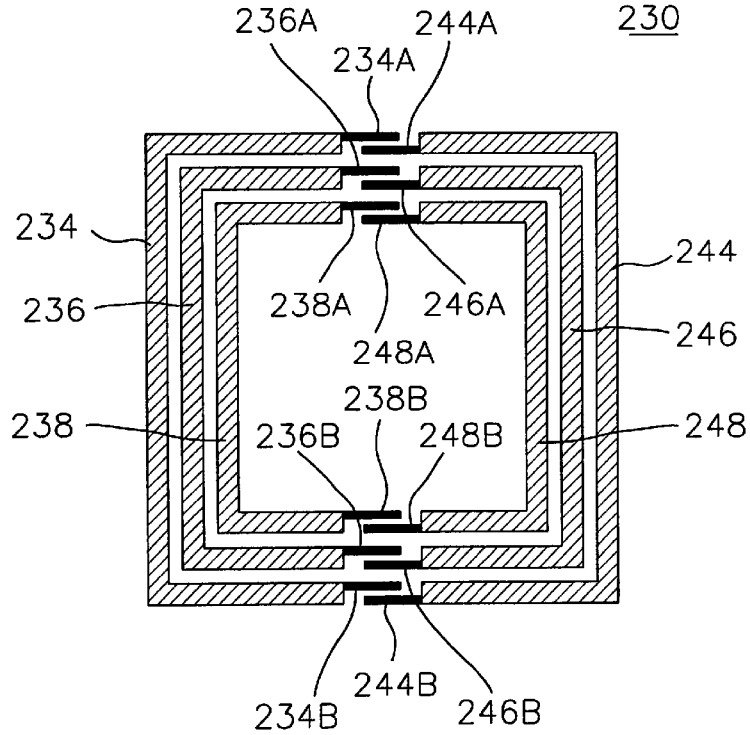
Figure 5C:
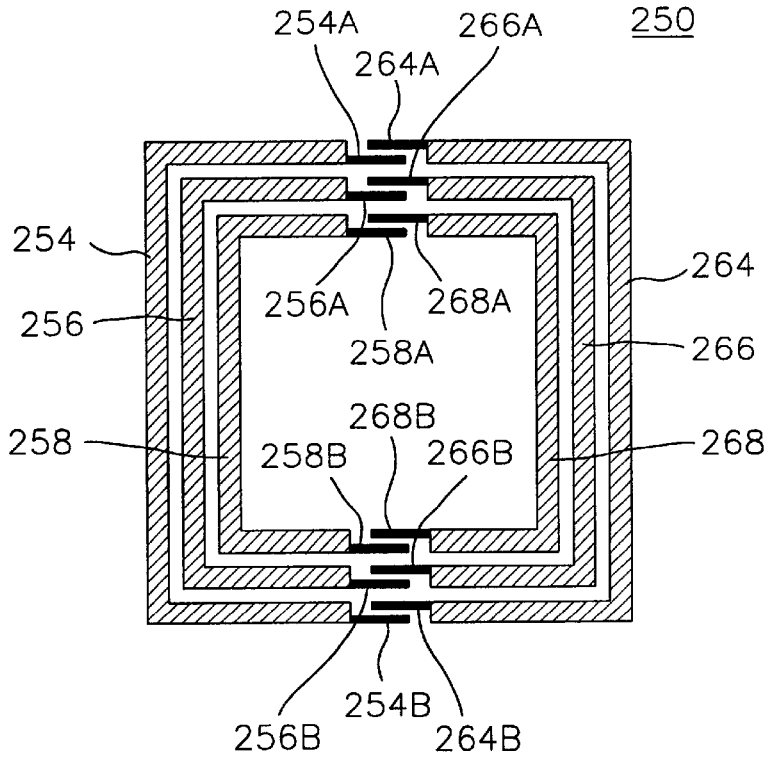
Figure 5D:
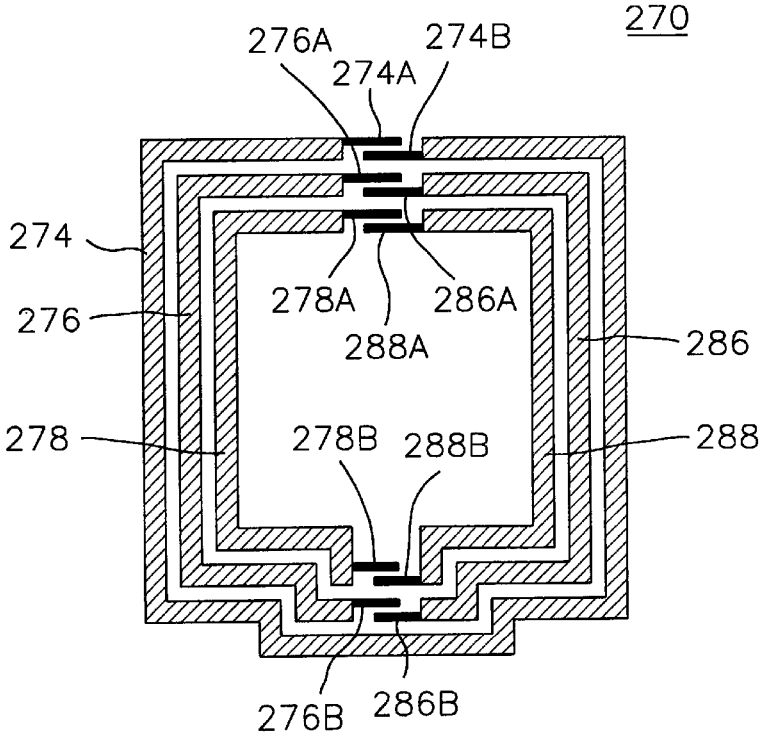
Figure 5E:
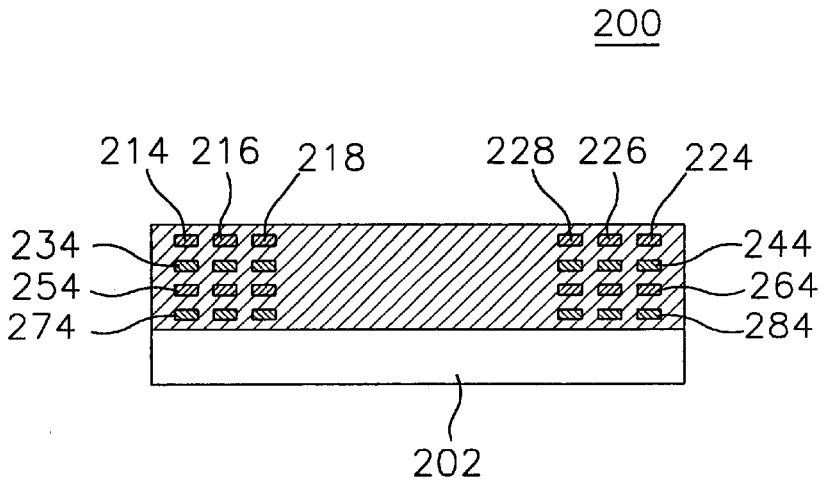
FIG. 5E presents a cross-sectional view of the symmetric multi-layer inductor shown in FIGS. 5A to 5D.

FIGS. 5A to 5D show layouts of metal patterned layers of a symmetric four-layer inductor 200, respectively shown in FIG. 5E in accordance with a third embodiment of the present invention. The symmetric four-layer inductor 200 comprises a substrate 202, a fourth, a third, a second and a first metal patterned layers 270, 250, 230, 210 successively formed on top of the substrate 202 and an insulating material 204 surrounding the metal patterned layers 270, 250, 230, 210, as shown in FIG. 5E.

FIG. 5A presents a layout of the first metal patterned layer 210 of the four-layer symmetric inductor 200 shown in FIG. 5E. The first metal patterned layer 210 includes a first set provided with an outmost metal line 214 and a pair of metal lines 216, 218 and a second set provided with an outmost metal line 224 and a pair of metal lines 226, 228. The outmost metal line 214 of the first set has an input port 212 at one end thereof and a via hole 214A at the other end thereof. Each of the metal lines of the first metal patterned layer 210 is in the form of a semi-rectangular loop with one end thereof substantially bent to facilitate its alignment with a corresponding metal line in the second metal patterned layer 230. The outmost metal line 224 of the second set has an output port 222 at one end thereof and a via hole 224A at the other end thereof. Each of the metal lines, e.g., 216, includes a bent portion 216C which is located at one end thereof and a pair of via holes 216A, 216B, the via holes 216A and 216B being placed at one end of the metal line 216 and the end of the bent portion 216C, respectively. All the via holes are filled with an electrically conducting material.

FIGS. 5B and 5C depict layouts of the second and third metal patterned layer 230, 250 of the symmetric multi-layer inductor 200 shown in FIG. 5E. Each of the second and the third metal patterned layer 230, 250 includes a first set of metal lines and a second set of metal lines.

FIG. 5D shows a layout of the fourth metal patterned layer 270 of the symmetric multi-layer inductor 200 shown in FIG. 5E. The fourth metal patterned layer 270 includes an outmost metal line 274, a first set of metal lines 276, 278 and a second set of metal lines 286, 288. The outmost metal line 274 of the fourth metal patterned layer 270 is in the form of an open rectangular loop. The metal lines 276, 278, 286, 288 of the fourth metal patterned layer 270 are in the form of a semi-rectangular loop, the semi-rectangular loops getting smaller as they get farther away from the outmost metal line 274. In accordance with the third preferred embodiment of the present invention, each of the metal lines, e.g., 216, is provided with a pair of via holes 216A, 216B, the via holes being filled with an electrically conducting material and located at both ends thereof, respectively. The first and the second set of metal lines in the metal patterned layers 210, 230, 250, 270 are symmetrical with respect to an imaginary central line.

In the inventive symmetric four-layer spiral inductor, a current flowing into the input port 212 flows into the metal line 244 of the second set in the second metal patterned layer 230 through the via holes 214A, 244A, after passing through the outmost metal line 214 of the first set in the first metal patterned layer 210, wherein the outmost metal line 214 of the first set and the metal line 244 of the second set are electrically connected to each other through the via holes 214A, 244A. The current after passing through the metal line 244 of the second set of the second metal patterned layer 230 flows into the metal line 216 of the first set in the first metal patterned layer 210 through the via holes 244B and 216B, through which the metal line 216 of the first set and the metal line 244 of the second set are electrically connected to each other. The current after flowing through the metal line 216 of the first set of the first metal patterned layer 210 flows into the metal line 246 of the second set of the second metal patterned layer 230 through the via holes 216A, 246A, through which the metal line 216 of the first set and the metal line 246 of the second set are electrically connected to each other. The current then flows into the metal line 218 of the first set of the first metal patterned layer 210 through the via holes 246B and 218B through which the metal line 218 of the first set and the metal line 246 of the second set are electrically connected to each other. The current, after flowing through the metal line 218 of the first set of the first metal patterned layer 210, flows into the metal line 248 of the second metal patterned layer 230 through the via holes 218A and 248A through which the metal line 218 of the first set in the first metal patterned layer 210 and the metal line 248 of the second metal patterned layer 230 are electrically connected to each other.

The current, after flowing through the metal line 248 of the second metal patterned layer 230, flows into the metal line 258 of the first set of the third metal patterned layer 250 through the via holes 248B and 258B, through which the metal line 248 of the second metal patterned layer 230 and the metal line 258 of the third metal patterned layer 250 are electrically connected to each other. The current after flowing through the metal line 258 of the first set in the third metal patterned layer 250 flows into the metal line 288 of the second set in the fourth metal patterned layer 270 through the via holes 258A and 288A, the via holes being used to electrically connect the metal line 258 of the first set to the metal line 288 of the fourth metal patterned layer 270. After flowing through the metal line 288 of the second set of the fourth metal patterned layer 270, the current flows into the metal line 256 of the first set of the third metal patterned layer 250 through the via holes 288B and 256B, the via holes being used to electrically connect the metal line 288 of the second set to the metal line 256 of the third metal patterned layer 250. The current flows therefrom into the metal line 286 of the second group of the fourth metal patterned layer 270 through the via holes 256A and 286A, the via holes being used to electrically connect the metal line 256 of the third metal patterned layer 250 to the metal line 286 of the second group of the fourth metal patterned layer 270.

Then, the current flows into the metal line 254 of the first set of the third metal patterned layer 250 through the via holes 286B and 254B, the via holes being used to electrically connect the metal line 286 of the second set in the fourth metal patterned layer 270 to the metal line 254 of the first set in the third metal patterned layer 250. The current after flowing through the metal line 254 flows into the outmost metal line 274 in the fourth metal patterned layer 270 through the via holes 254A and 274B, the via holes being used to electrically connect the metal line 254 of a first set in the third metal patterned layer 250 to the outmost metal line 274 in the fourth metal patterned layer 270.

The current after passing through the outmost metal line 274 of the fourth metal patterned layer 270 flows into the metal line 264 of the second set in the third metal patterned layer 250 through the via holes 274A and 264A, through which the outmost metal line 274 of the fourth metal patterned layer 270 and the metal line 264 of the second set are electrically connected to each other. The current after flowing through the metal line 264 of the second set of the third metal patterned layer 250 flows into the metal line 276 of the first set of the fourth metal patterned layer 270 through the via hole 264B, 276B, through which the metal lines 264 of the second set of the third metal patterned layer 250 and the metal line 276 of the first set of the fourth metal patterned layer 270 are electrically connected to each other. The current then flows into the metal line 266 of the second set of the third metal patterned layer 250 through the via holes 276A and 266A through which the metal line 276 of the first set and the metal line 266 of the second set are electrically connected to each other.

The current, after flowing through the metal line 266 of the second set of the third metal patterned layer 250, flows into the metal line 278 of the fourth metal patterned layer 270 through the via holes 266B and 278B through which the metal line 266 of the second set in the third metal patterned layer 250 and the metal line 278 of the fourth metal patterned layer 270 are electrically connected to each other.

The current, after flowing through the metal line 278 of the fourth metal patterned layer 270, flows into the metal line 268 of the second set of the third metal patterned layer 250 through the via holes 278A and 268A, through which the metal line 278 of the fourth metal patterned layer 270 and the metal line 268 of the third metal patterned layer 250 are electrically connected to each other. The current then flows into the metal line 238 of the first set of the second metal patterned layer 230 through the via holes 268B and 238B, the via holes being used to electrically connect the metal line 268 of the second set of the third metal patterned layer 250 to the metal line 238 of the second metal patterned layer 230. The current after flowing through the metal line 238 of the first set in the second metal patterned layer 230 flows into the metal line 228 of the second set in the first metal patterned layer 210 through the via holes 238A and 228A, the via holes being used to electrically connect the metal line 238 of the first set to the metal line 228 of the first metal patterned layer 210. After flowing through the metal line 228 of the second set of the first metal patterned layer 210, the current flows into the metal line 236 of the first set of the second metal patterned layer 230 through the via holes 228B and 236B, the via holes being used to electrically connected the metal line 228 of the second set to the metal line 236 of the second metal patterned layer 230.

Then, the current flows into the metal line 226 of the second set of the first metal patterned layer 210 through the via holes 236A and 226A, the via holes being used to electrically connect the metal line 236 of the first set in the second metal patterned layer 230 to the metal line 226 of the second set in the first metal patterned layer 210. The current after flowing through the metal line 226 flows into the metal line 234 in the second metal patterned layer 230 through the via holes 226B and 234B, the via holes being used to electrically connect the metal line 226 of the second set in the first metal patterned layer 210 to the metal line 234 in the second metal patterned layer 230. The current flows into the metal line 224 of the second set of the first metal patterned layer 210 through the via holes 234A and 224A and passes out through the output port 222, the via holes being used to electrically connect the metal line 224 of the first metal patterned layer 210 to the metal line 234 of the second metal patterned layer 230.

In comparison with the dual-layer spiral inductor 100, the present four-layer symmetric inductor 200 provides nearly 4 times the inductance of the dual-layer spiral inductor 100 for a given silicon area.

Figure 6:
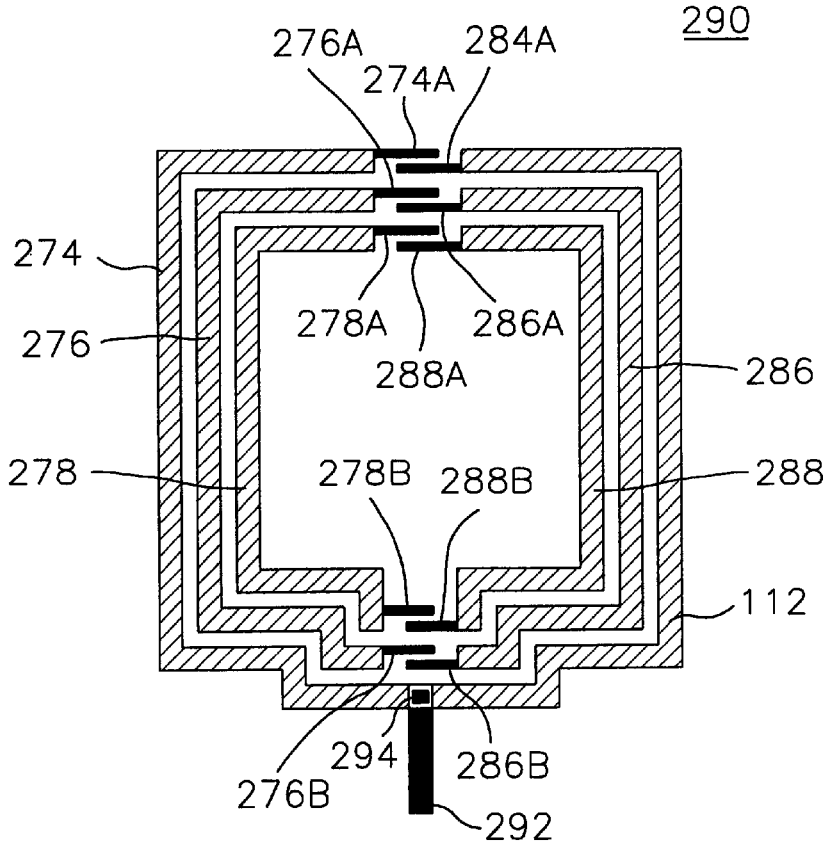
FIG. 6 depicts a layout of a first metal patterned layer of the symmetric multi-layer inductor in accordance with a fourth preferred embodiment of the present invention.

In FIG. 6, there is shown a layout of a fourth metal patterned layer 290 of a multi-layer symmetric inductor in accordance with a fourth preferred embodiment of the present invention. The fourth metal patterned layer 290 of this embodiment is similar to the fourth metal patterned layer 270 shown in FIG. 5D except that the outmost metal line 274 is divided into two portions by a via hole 292 located at a center thereof. An additional port 294 is connected to the via hole 292, thereby allowing the multi-layer symmetric inductor incorporating therein the fourth metal patterned layer 290 to serve as two inductors whose inductances are equal to each other.

Even though the present invention has been described for a symmetric inductor incorporating therein two metal patterned layers having three turns, respectively, the idea presented above can be extended to any other inductor incorporating therein M number of metal patterned layers which have N number of turns in each of the metal patterned layers, respectively, provided that the metal patterned layers are symmetric, wherein M is an even and positive integer and N is a positive integer.

While the present invention has been described with respect to the preferred embodiments, other modifications and variations may be made without departing from the spirit and scope of the present invention as set forth in the following claims.

What is claimed is:

1. A symmetric dual-layer spiral inductor incorporating spirals, each spiral having N number of turns, N being a natural number greater than or equal to 1, comprising:

a substrate;

a top metal patterned layer provided with a 1st group of N number of first metal lines and a 2nd group of N number of second metal lines;

a bottom metal patterned layer, disposed between the substrate and the top metal patterned layer, provided with a 1st group of N number of third metal lines and a 2nd group of N number of fourth metal lines, each of the metal lines having a 1st and a 2nd end and an inner metal line size being smaller than that of an outer metal line, each of 1st ends of the first metal lines being electrically connected to a 1st end of the corresponding fourth metal line, a 2nd end of the fourth metal line being electrically connected to a 2nd end of a first metal line having a turn number of one less than that of the previous first and fourth metal line, a 2nd end of a fourth metal line having a smallest turn number being connected to that of a third metal line having a smallest turn number, each of the 1st ends of the third metal lines being electrically connected to a 1st end of a corresponding second metal line and a 2nd end of the corresponding second metal line being electrically connected to a 2nd end of a third metal line having a turn number of one greater than that of the previous second and third metal line; and an insulating material surrounding each of the metal lines.

2. The symmetric dual-layer inductor of claim 1, wherein the first metal lines and the second metal lines are symmetrical to each other with respect to an imaginary central line.

3. The symmetric dual-layer inductor of claim 2, wherein the third metal lines and the fourth metal lines are symmetrical to each other with respect to an imaginary central line.

4. The symmetric dual-layer inductor of claim 3, wherein each of the metal lines of the top and bottom metal patterned layer is in the form of a semi-rectangular loop.

5. The symmetric dual-layer inductor of claim 4, wherein the third and fourth metal line of the bottom metal patterned layer having a smallest turn number are joined together to thereby form an open rectangular loop.

6. The symmetric dual-layer inductor of claim 4, wherein each of the first and the second metal lines of the top metal patterned layer has a bent portion located at the 2nd end thereof to facilitate its alignment with a corresponding metal line in the bottom metal patterned layer.

7. The symmetric dual-layer inductor of claim 1, wherein the substrate is made of silicon.

8. The symmetric dual-layer inductor of claim 7, wherein the insulating material is made of $SiO_2$.

9. The symmetric dual-layer inductor of claim 1, wherein each end of the metal lines has at least one via hole.

10. The symmetric dual-layer inductor of claim 9, wherein the via hole is filled with an electrically conducting material for electrically connecting two appropriate metal lines.

11. The symmetric dual-layer inductor of claim 1, wherein a first metal line with a largest turn number has a via hole located at a 1st end thereof and an input port located at a 2nd end thereof.

12. The symmetric dual-layer inductor of claim 11, wherein a second metal line with a largest turn number has a via hole located at a 1st end thereof and an output port located a 2nd end thereof.

13. The symmetric dual-layer inductor of claim 1, wherein an additional port is formed on 2nd ends of a third and fourth metal line having a smallest turn number, whereby the symmetric dual-layer inductor is utilized as a pair of inductors whose inductances are exactly same.

14. A multi-layer spiral inductor comprising:

a substrate;

an M number of metal pattern layers formed on the substrate, M being an even number and each metal patterned layer being provided with an N number of first half spiral metal lines, N being an integer and an N number of second half spiral metal lines, wherein the first and the second half spiral metal lines are electrically connected in series to form one inductor structure; and an insulating material formed between the stacked metal patterned layers, wherein each of the first and the second half spiral metal lines has two ends and at least one end of each first half spiral metal line is electrically connected to one end of a second half spiral metal line in a neighboring metal patterned layer thereof and at least one end of each second half spiral metal line is electrically connected to one end of a first half spiral metal line in a neighboring metal patterned layer thereof.

15. The symmetric multi-layer inductor of claim 14, wherein the substrate is made of silicon.

16. The symmetric multi-layer inductor of claim 15, wherein the insulating material is made of $SiO_2$.

* * * * *